US006769234B2

(12) United States Patent
Hadlock

(10) Patent No.: US 6,769,234 B2
(45) Date of Patent: Aug. 3, 2004

(54) METHOD FOR FITTING A HORSE FOR A SADDLE PAD OR RIDING SADDLE

(76) Inventor: William Bret Hadlock, 750 High Low Dr., New Braunfels, TX (US) 78132

( * ) Notice: Subject to any disclaimer, the term of this patent is extended or adjusted under 35 U.S.C. 154(b) by 0 days.

(21) Appl. No.: 10/235,257

(22) Filed: Sep. 5, 2002

(65) Prior Publication Data

US 2004/0045266 A1 Mar. 11, 2004

(51) Int. Cl.[7] ..... B68C 1/02; B68C 33/40
(52) U.S. Cl. ..... 54/44.1; 264/222
(58) Field of Search ..... 54/44.1; 264/222

(56) References Cited

U.S. PATENT DOCUMENTS

| | | | | |
|---|---|---|---|---|
| 224,784 | A | * 12/1880 | Johnstone | 602/12 |
| 339,334 | A | * 4/1886 | Searle | 264/222 |
| 410,383 | A | * 8/1889 | Stahl | 264/152 |
| D31,409 | S | 8/1899 | Padgitt | |
| 1,357,823 | A | 11/1920 | Read | |
| 1,647,639 | A | * 11/1927 | Larson | 12/133 M |
| 2,072,188 | A | 3/1937 | Tauber | |
| 3,130,530 | A | 4/1964 | Foreman | |
| 3,286,440 | A | 11/1966 | Walker et al. | |
| 3,323,287 | A | 6/1967 | Hilmer | |
| 3,371,467 | A | 3/1968 | Salisbury, III | |
| 3,405,506 | A | * 10/1968 | Kostur | 54/82 |
| 3,624,695 | A | 11/1971 | Roberts, Jr. | |
| 3,807,136 | A | 4/1974 | Deal | |
| 3,835,621 | A | 9/1974 | Gorenschek | |
| 3,888,070 | A | 6/1975 | White et al. | |
| 3,971,194 | A | 7/1976 | Morgan | |
| 4,136,506 | A | 1/1979 | Miller | |
| D251,623 | S | 4/1979 | Abercrombie, Jr. | |
| 4,287,705 | A | 9/1981 | Frost et al. | |
| 4,324,090 | A | 4/1982 | Nix | |
| 4,471,538 | A | 9/1984 | Pomeranz et al. | |
| 4,524,570 | A | 6/1985 | Racinet | |
| 4,669,255 | A | 6/1987 | Wicks | |
| 4,671,049 | A | 6/1987 | Benckhuijsen | |

(List continued on next page.)

FOREIGN PATENT DOCUMENTS

| | | |
|---|---|---|
| EP | 0566608 B1 | 1/1998 |
| GB | 18176 | of 1894 |
| GB | 378365 | 4/1932 |
| GB | 0764607 B1 | 5/2000 |
| WO | WO 9602460 A1 | 2/1996 |
| WO | WO 99/18028 | 4/1999 |

OTHER PUBLICATIONS

Pelham Saddlery, Saddle Fitting explained and illustrated, Aug. 14, 2001, taken from The Wayback Machine—http://web.archive.org, searching for http://pelham–saddlery.com/fitting.html.*

Peter Horobin, Saddles, Feb. 14, 1997, taken from The Wayback Machine—http://web.archive.org, searching for http://cyberhorse.net.au/horobin/saddles.htm.*

Peter Horobin, Saddle Fitting, No Date, found at http://www.horobin.com.au/saddlefitting.htm.*

EQUImeasure Kit. EQUImeasure Incorporated. Nov. 12, 2001.

US 6434915 B1 Aug. 20, 2002 De Cosemo.

*Primary Examiner*—Charles T. Jordan
*Assistant Examiner*—Bret Hayes
(74) *Attorney, Agent, or Firm*—Charles W. Hanor, P.C.

(57) ABSTRACT

A method for fitting a horse for a custom fitting saddle pad or saddle. The steps include positioning a horse in a working position, marking a first reference line and a second reference line, positioning a pad on the horse's back, securing the pad on the horse's back, forming a cast of the horse's back, and removing the cast from the horse to be transported.

4 Claims, 7 Drawing Sheets

U.S. PATENT DOCUMENTS 4,683,709 A 8/1987 Vasko et al.
4,685,453 A * 8/1987 Guignard et al. ..... 602/7
4,695,496 A 9/1987 Lee
4,745,734 A 5/1988 Brown
4,765,126 A 8/1988 Bates
4,860,524 A 8/1989 Dumoulin et al.
4,965,988 A 10/1990 Anderson
4,974,397 A 12/1990 Ricken
5,018,340 A 5/1991 Marshall
5,018,341 A 5/1991 Evertson
5,027,589 A 7/1991 Gleb et al.
5,048,272 A 9/1991 Saare
5,058,367 A 10/1991 Evertson
5,175,986 A 1/1993 Farley
5,191,752 A 3/1993 Murphy
5,195,306 A 3/1993 Hadlock
5,343,674 A 9/1994 Brown
5,375,397 A 12/1994 Ferrand et al.
5,383,328 A 1/1995 Brown
5,435,116 A 7/1995 Brown
5,456,072 A 10/1995 Stern
5,517,808 A 5/1996 Schleese
5,575,139 A 11/1996 Green
5,577,372 A 11/1996 Gronberg
5,782,070 A 7/1998 Knight et al.
5,787,692 A 8/1998 Purdy
5,799,473 A 9/1998 Goblet
5,802,823 A 9/1998 Woods
5,884,459 A 3/1999 Biddlecome
5,901,532 A 5/1999 Bopp
5,953,889 A 9/1999 Jones
6,044,630 A 4/2000 Coffin
6,050,067 A 4/2000 Knight et al.
6,125,616 A 10/2000 Brown
6,223,509 B1 5/2001 Girault
6,272,817 B1 8/2001 Further
6,334,262 B1 1/2002 Ferrand
6,443,986 B1 * 9/2002 Malice et al. ..... 623/7
2002/0078666 A1 6/2002 Bates

* cited by examiner

METHOD FOR FITTING A HORSE FOR A SADDLE PAD OR RIDING SADDLE

BACKGROUND OF THE INVENTION

1. Field of the Invention

The present invention relates to a method of fitting a horse for a saddle pad or a riding saddle and, more particularly, to a method of fitting a horse that does not require transporting the horse to a fitting location or a trained fitting professional to travel to the horse.

2. Description of the Related Art

Bruising and making sore a horse's back has been a problem with known prior art riding saddles, because most saddles may concentrate the combined weight of saddle and rider (or pack) at a relatively few and small points of contact between the saddle and the back of the horse. Bruising may result at these points of contact when the pressure exceeds about 1½ pounds per square inch, which is the amount of pressure some considered to be the maximum before bruising occurs.

For example, a typical western-type saddle includes a tree frame with two relatively straight sidebars. The natural sway of a horse's back in the vicinity of the center of these bars often prevents supporting contact between the horse's back and the bars at this point. As a result, the combined weight of saddle and rider may be supported or concentrated at the four areas of contact in the vicinity of the forward and rearward portions of each bar. The total effective supportive contact area with this type of saddle (ill-fitting) may be typically about 36 square inches, which results in about 5½ pounds of pressure per square inch of contact for a 200 pound load well in excess of the recommended 1½ pounds per square inch. The amount of pressure exerted by the forward part of the saddle is even more concentrated because saddles are desirably designed to concentrate more of the weight at the forward end of the saddle to be more directly over the horse's front legs. The bruising problem is particularly aggravated when the horse is under saddle for long periods of time over rough terrain. These conditions commonly occur during competitive endurance riding.

Saddles and saddletrees have remained more or less fixed in size and shape based on standards established centuries ago. While some saddletrees are being made from synthetic materials such as plastic and fiberglass, many trees are still being made of wood. A wood tree is covered in rawhide as has been the practice for centuries; or, is covered in fiberglass if more modern materials are being used. As a result, a Western tree may weigh in the neighborhood of forty pounds. By the time leather covering and padding is added, the resultant saddle may weigh upwards of fifty to sixty pounds. The tree itself is typically of one-piece construction and comprises a pommel in the front (with or without a horn) and a cantle in the back connected by sidepieces. Basically; there is the Arabian tree and the Quarter horse tree. The only difference is the distance between the sidepieces and the vertical rise of the pommel (so as to fit around the withers without contacting). A saddletree is supposed to fit over the ridge of a horse's back at both the pommel and cantle and the sidepieces are supposed to fit along the back of the horse on either side of the ridge spreading the weight of the rider over a large area.

Typically, saddles are sized by measuring the distance from the pommel to the cantle with a fifteen-inch saddle considered small and an eighteen-inch saddle considered large. Thus, the size variations of standard saddles are relatively small. Unfortunately, such is not the case for the horses.

When placing a saddle on the back of a horse, it is essential that the saddle not tilt to either side or forward/backward. Furthermore, it is important that the saddle not rock longitudinally. Attempts to satisfy such requirements have used different kinds of cushion paddings, which are adapted between the horse's back and the saddle frame to places considered functional.

However, the backs of horses have individual shapes both in the transverse and longitudinal direction of the back. Moreover, as the above-mentioned cushion paddings may be factory-made and thus of standard shape and size, such cushion paddings may not satisfy the requirements listed above. Furthermore, ready-made cushion paddings may generally comply unsatisfactorily with the shape of the back of the horse, which may cause back pain and even injure the back of the horse. Such an outcome is difficult to prevent, since the poor compatibility of the cushion paddings is typically noted only after the horse's back has become sore. A further problem in the correct placement of the cushion paddings is caused by the saddle, which prevents visual and tactile inspection to determine where to add or remove padding. Also the mounting of the rider on the saddle changes its position and complicates the fitting of the paddings.

One attempt to solve the problem of improperly fitted saddles is the banana shaped pad that is curved along its longitudinal length like a banana. Several companies marker a banana shaped pad today. The banana pad may be made of two pieces that are banana shaped so that the pad is contoured to fit the contour of a horse's spine line. The banana pad can be distinguished from standard pads that are just a square felt pad. While banana pads help, they do not solve the problem of injury to horse because of ill-fitted saddles. In addition to factory-made paddings, horsehair and rags have been employed for saddle pads. However, these materials have the same basic deficiencies as factory-made cushion paddings.

Numerous prior art devices have attempted to solve the bruising and the making the backs of horses sore.

U.S. Pat. No. 2,353,622 to Boyle provides for rigid contact plates supported by ball and socket joints at the front and rear of each rail of the saddle. These contact plates do not flex and are unable to continuously conform to the changing shape of the horse's back as it moves. Additionally, the individual plates are not intended to flex in order to conform to the shape of the horse's back.

For example, U.S. Pat. No. 3,286,440 to Walker, et el. provides a lightweight, rigid saddle. This saddle, however, does not specifically conform to the shape of a horse's back and as a result the weight of the rider and saddle may be distributed to only a few points of contact, depending upon the shape of the individual horse's back. Even though the saddle is designed to be lightweight, this does nothing to lessen the weight of the rider or distribute the weight evenly over the surface of the horse's back.

U.S. Pat. No. 3,371,467 to Salisbury provides for a custom, molded fiberglass, reinforced saddle. The saddletree is reinforced fiberglass made from upper and lower shells. The lower shell is contoured to fit the back of the horse and on each side has a convex front portion adapted to fit onto the withers and a convex rear portion adapted to fit onto the back of a horse, with a central ridge forming a tunnel extending longitudinally of the shell and being sufficiently high to clear the backbone of the horse. The saddle is intended to evenly distribute the weight of the rider and saddle over the back of the horse when the horse is at rest.

However, the saddle does not flex to conform to the continuously changing configuration of the horse's back as it is moving. That is, the shoulders of the horse change shape as the horse moves and in as much as the weight of the rider and saddle tend to be concentrated at the forward end of the saddle, on the sides of the withers, the bruising and making sore problem continues.

U.S. Pat. No. 3,835,621 to Gorenschek provides for a flexible saddletree in which the entire saddle is flexible. The invention of the Gorenschek patent requires that the tree frame on the saddle itself be flexible and does not allow for a standard rigid tree frame to be adapted for flexible conforming fit with the back of a horse.

U.S. Pat. No. 4,745,734 discloses a riding saddle including a tree frame having first and second, spaced-apart, generally parallel bars; first and second flexible skirts each having a surface area respectively greater than the surface area of lower face of the side bars; and fasteners coupling the skirts with the lower face of their corresponding bars. The skirts have flexing portions and flex to conform to the contours of the back of the horse on which the saddle is placed and are biased to return to the unflexed position when the saddle is removed from the horse. Preferably, the skirts include a layer of polycarbonate resin or plastic, a layer of foam rubber, and a layer of fleece-like material.

U.S. Pat. No. 5,048,272 discloses attaching a saddle to an equine by means of left and right bar straps attached to the left and right bars in the saddletree. The bars are slotted to receive the stirrup leathers for mounting in the conventional western style. The use of bar straps does not interfere with such mounting of the stirrups, owing to the way in which the bar straps are mounted to the bars. In a preferred embodiment each bar strap starts on the outside of its associated bar and proceeds upward, over the top of the bar and thence downward along the inside of the bar. If the starting point is very near the bottom of the bar a slot in the bar strap aligns with the stirrup slot in the tree. In another embodiment a long length of strap is looped over the top portion of the bar above the slot, with the outer segment of the loop passing through the stirrup slot. The two portions of the loop rejoin each other on the underside of the bar, where the two proceed downward as one. In either embodiment the bottom end of each bar strap is fitted with an optical transition and with a fastener, such as billet straps, to connect to the remaining portion of the rigging. Owing to the length of the bar straps, the location of the fastening to the remainder of the rigging is such that it is not in the vicinity of the knees of a short rider.

U.S. Pat. No. 5,119,618 uses a multi-layer pad that includes a flexible pressure plate members and packets filled with a fluid gel of a silicone material to transfer localized forces from the saddle across the pressure plate which has deformed to the shape of the horse's back there under. The packets lie against the pressure plate members with the fluid confined therein between the saddle and the pressure plate members so that localized forces from the saddle are hydraulically transferred over the surface of the pressure plates and over a broad area of the back of the horse.

U.S. Pat. No. 5,195,306 discloses a saddletree constructed of upper and lower plastic shells which are secured together. A first strap passes inside the saddletree below the swell and pommel area and a second strap passes inside the saddletree below the cantle area, both may be attached to the upper surface of the lower shell near the centerline of the saddletree and depend from the saddletree on both sides of the attachment of other saddle rigging components.

U.S. Pat. No. 5,435,116 discloses a racing saddle which flexibly confirms to a horse's back to accommodate the physically characteristics of a given horse, and incorporates a damping system to preclude excessive vibrations in the flexible materials. The saddletree includes a pair of laterally spaced apart, flexible synthetic skirts connected by a spanning member and a seat clement. The seat element is coupled with the respective skirts at two forward pivot mountings, and the spanning member extends between the skirts at a rearward position. The seat element carries a skid assembly at a position just rearward of the pommel, and this assembly deforms under compressive loading to provide damping action. The cantle portion of the seat element slidably and frictionally engages the top of the spanning member.

U.S. Pat. No. 5,802,823 discloses a shock absorbing panel assembly for positioning beneath a saddle and includes right-hand and left-hand panels for positioning in pockets in a saddle pad or blanket on the right-hand and left-hand side of a horse's back. Each panel is of multi-layer construction and includes a base with at least one layer of foam or other cushioning material and one layer of non-cushioning material. The base has at least two recesses and a shock absorbing pad is mounted in each recess to project out of the recess. Each pad also has two layers of cushioning material with an intervening layer of non-cushioning material.

U.S. Pat. No. 6,044,630 discloses a saddle that is constructed around a tree designed using data points based on X, Y, and Z axes which correspond to the conformation of a horse's back. Two pair of torsion springs, attached with specifically placed rivets, sandwich the tree providing structural support. To cushion and maintain the equidistant configuration of the tree, panels are carefully constructed using a six-pound foam. The thickness of the panel lessens as it reaches the edge of the tree, preventing bunching when the leather is attached. A withers wedge is secured to the panel adjacent the withers, serving as a sub-support and buffering the contact between the tree and the horse's withers. The cantle wedge is set into the panel to control the slant and angle of the saddle. The stirrup bar is an elongated V-shaped which places the area of greatest pressure directly under the securing rivets.

U.S. Pat. No. 6,334,262 discloses a device and method of measurement of a horse's back that employs a mechanical device having articulated transverse linkages comprising a parallelogram assembly having the first arm as one link, an opposing link, and further comprising a hub member, with transverse opposing wings each of the wings being pivotally joined to the hub member for defining shape and indicia to determine a series of angles. The measuring device is able to describe angles and arcs in order to determine the convex and concave portions of polyform shapes—in this preferred embodiment relating to animal backs and their corresponding saddles. The disclosed invention describes a method and formula to adjust the shape of such a device to compensate for the weight of the rider relative to the weight of the animal as well as additional factors is also provided by this process. Additional calibration of the measuring device can also be refined by employing interface pressure measurement.

An object of the invention is a system and method by which a precision casting is created of the surface area of a horse's back where a saddle would be located. The precision cast can be made without the need to transport the horse to a specially equipped facility or require a trained horse fitting professional to travel to the location where the horse is located.

Another object of the invention is the creating of a precision casting of the horse's back so that a future fiberglass prosthetic shell that molds to the contours of the horse's back can be made. The fiberglass shell can be placed in between the layers of a horse saddle pad or can be used to make a saddle. The shell can be used to store the saddle, allowing the saddle to remain in the same shape as if the saddle were on the horse.

Another object of the invention is the advantage of having a rigid layer conforming to the unique contours of the horse for which it was made sandwiched between the saddle and the horse's back is that the pressure being exerted on the back of the horse from the load placed on the saddle as well as the mass of the saddle becomes evenly distributed over the entire area on which the fiberglass shell is positioned. A relief area is placed along the ridge where the horse's spine and withers would come into contact with the shell, thereby insulating the spine from directly bearing the load. This withers relief line effectively reduces physiological injuries resulting from uneven load distributions, pressure points, and poorly fitting saddles.

Still other objects, features, and advantages of the present invention will become evident to those of ordinary skill in the art in light of the following.

BRIEF SUMMARY OF THE INVENTION

A system and method for fitting a horse for a saddle pad or a saddle that includes positioning a horse in a working position with a head down so that the neck is horizontal and a spine is linear. The next step is the marking of first and second reference marks on the horse. The person doing the fitting then positions a pad on a back of the horse with a slit facing the head, a centerline in parallel alignment with the spine, and first and second pad marks in parallel alignment with the first and second reference marks, respectfully. The fitter then secures the pad on the back with a plastic wrap wrapped around the entire circumference of the pad and a midsection of the horse. The fitter then place a formable casting material onto the pad to form a cast of the back of the horse. The casting is then checked to make sure it conforms to the contour of the horse's back and is then transported to a saddle or pad shop or manufacturing facility to be made into a saddle pad or saddle.

DETAILED DESCRIPTION OF THE INVENTION

Figure 1:
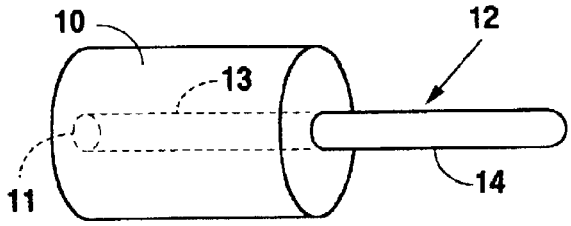
FIG. 1 is a perspective view of a spool of stretchable plastic with a holder.

Individuals choosing to have a casting conforming to the unique contours of a horse purchase a cast fitting kit that will contain the following: a conventional sharp knife (optional), a conventional pair of sharp scissors (optional), a conventional piece of chalk (optional), a conventional flexible forming tool 70, a conventional spool of stretchable plastic wrap 10 and a spool holder 12, a horse pad 20, a measuring tool 40, a first cutout blank 50, a second cutout blank 60, and a plaster cast blanket 30.

Figure 12:
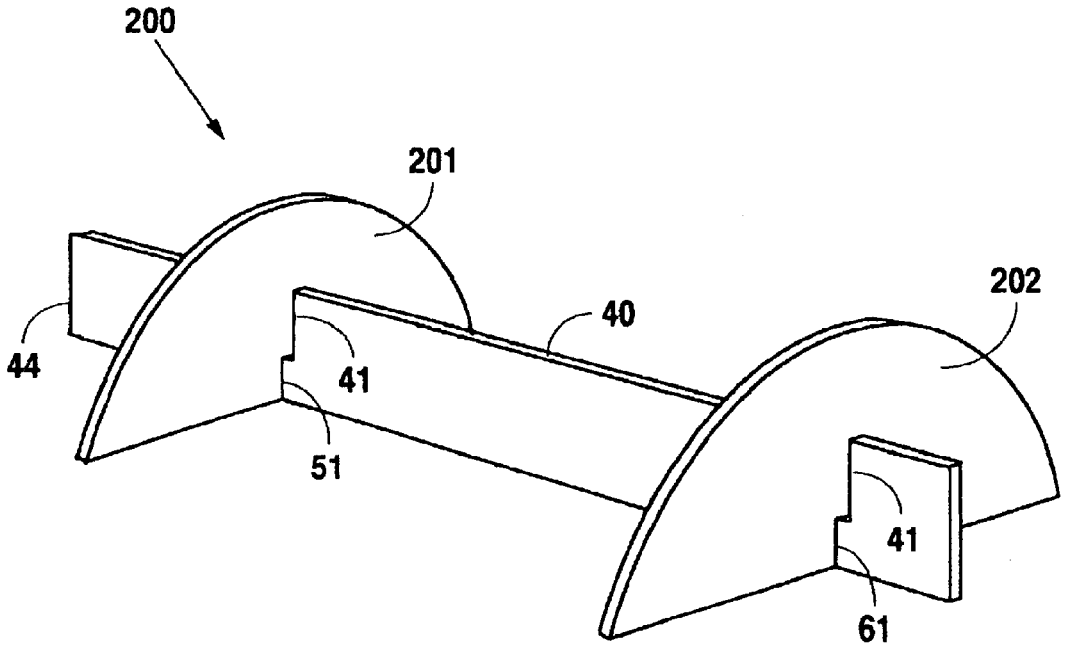
FIG. 12 is a perspective view of a cradle.

A shipping box is used both for transporting the cast fitting kit to the customer and for transporting a final cast 36 resting on a cradle 200, FIG. 12, back to the manufacturer to make a saddle pad or saddle. The shipping box can be any shipping box commonly known in the public big enough to contain the final casting and all the items in the cast fitting kit. The sharp knife, scissors, and piece of chalk can be of any conventional type commonly known to the public. In addition, the chalk can be any color that will clearly show up on a horse's hide.

Referring to FIG. 1, the spool of stretchable plastic wrapping or strapping material 10 is a roll of clear plastic wrap having a spool holder 12 rotatably mounted in cylindrical opening 11 in the center. The plastic wrap 10 is capable of stretching slightly when force is applied. Additionally, the plastic wrap 10 must adhere to itself via electrostatic charge. The plastic wrap 10 is several inches wide and many feet long, so as to be able to circumnavigate a midsection 2 in a shallow spiral, eventually covering the entire midsection 2 from the withers 3 to the hindquarters 4.

The spool holder 12 is a shaft with a coupling end 13 and a handle 14. The coupling end 13 rotatively couples with the spool 10 via insertion into the through hole 11. The handle 14 allows the plastic wrap 10 to be unrolled, while exerting force in the form of tension so that the plastic wrap 10 is slightly stretched while being applied. At the same time, the handle 14 allows the operator to have precise control of the exact position of the newly unrolled plastic wrap 10.

Figure 2:
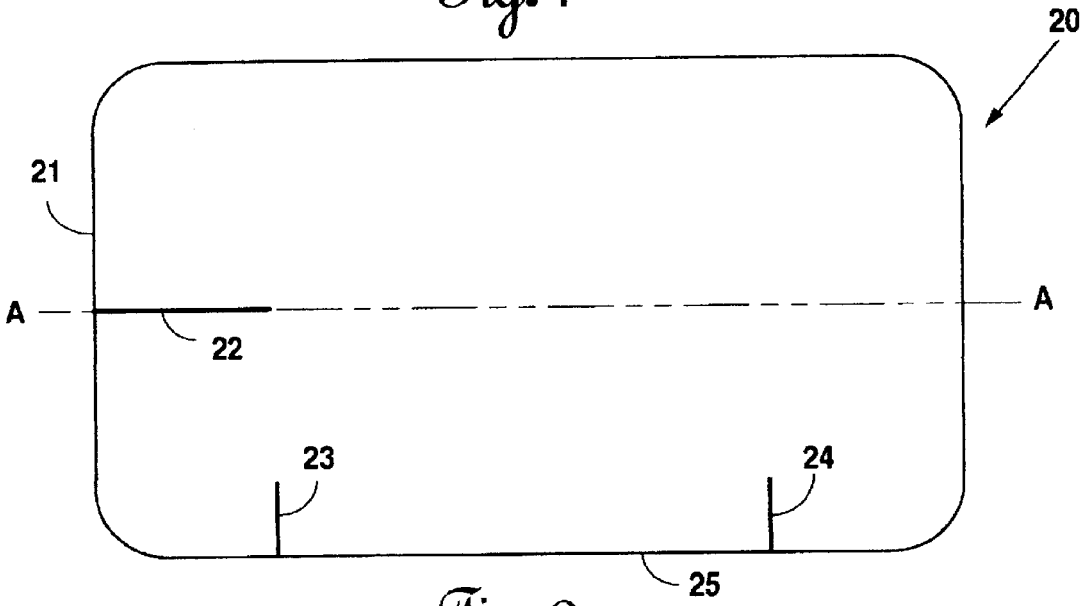
FIG. 2 is an overhead view of a horse pad.

Referring to FIG. 2, the standard horse pad 20 is a generally rectangular shape with rounded corners. The pad 20 is sized to fit on a typical horse's back 5, and is located on and covering the area where a saddle would be placed when the horse is properly saddled. A pad slit 22 extends from a front edge 21 along a centerline A—A for a short distance. This slit 22 allows the pad 20 to fit evenly onto the horse's back 5 by permitting a protruding area of the withers 3 to project through the slit 22 while the pad 20 conforms to the horse's back S. The length of the slit 22 can be increased if necessary to fit a particular horse. Without the slit 22, the withers 3 might prevent the pad 20 from properly conforming to the horse's back 5. A first pad mark 23 and second pad mark 24 extend perpendicular from a left edge 25 of the pad 20. The marks 23 and 24 are spaced on the pad 20 so that when the pad 20 is properly positioned on the horse's back 5, the marks 23 and 24 will align with a first reference mark 100 and second reference mark 101, which will be fully described below regarding FIG. 7.

Figure 3:
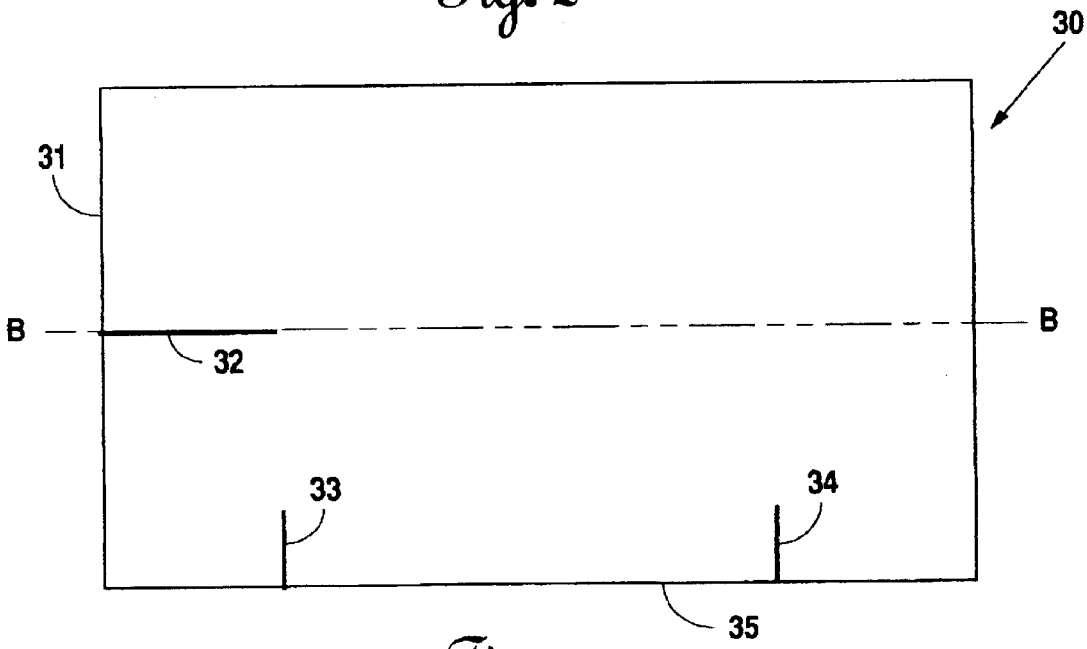
FIG. 3 is an overhead view of a plaster cast blanket.
Figure 7:
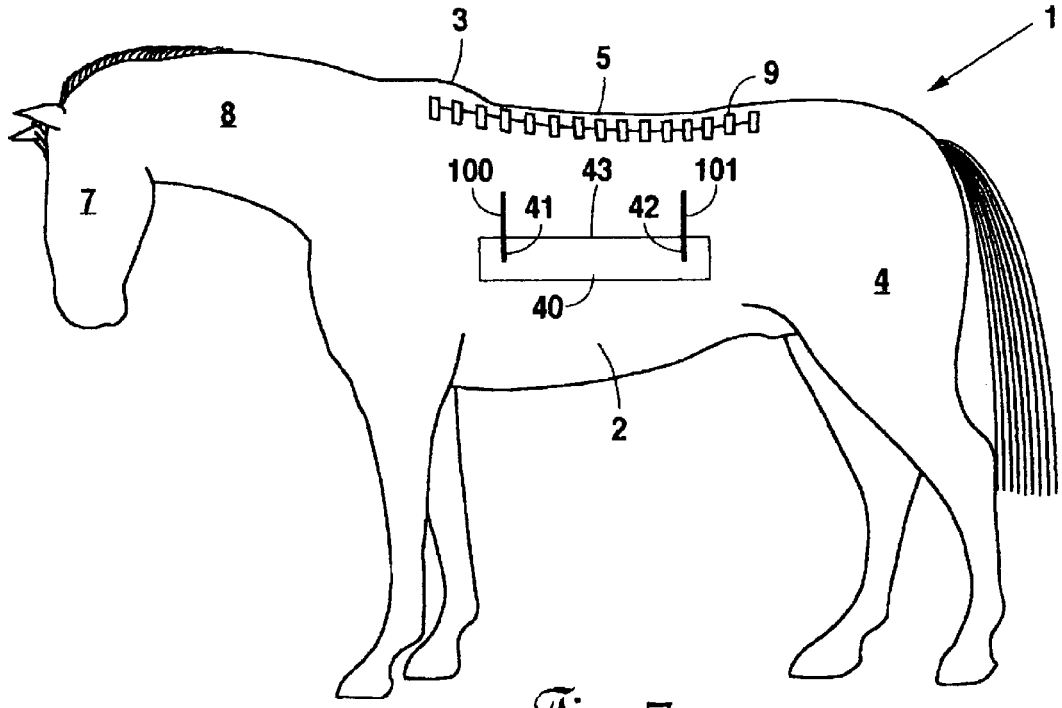
FIG. 7 is a side view of the first reference line and a second reference line on the horse.

Referring to FIG. 3, the plaster cast blanket 30 is a generally rectangular shape that has slightly smaller dimensions than the horse pad 20. A blanket slit 32 extends from a front edge 31 along a centerline B—B for a short distance to coincide with the matching slit in the pad. This slit 32 also allows the plaster cast blanket 30 to fit evenly onto the horse's back 5 by permitting the protruding area of the withers 3 to project through the slit 32, if necessary while the plaster cast blanket 30 conforms to the horse's back 5. Without the slit 32, the withers might prevent the pad 20 from properly conforming to the horse's back 5. A first blanket mark 33 and second blanket mark 34 extend perpendicular from a left edge 35 of the plaster cast blanket 30. The marks 33 and 34 are spaced on the plaster cast blanket 30 so that when the plaster cast blanket 30 is properly positioned on the horse's back 5, the marks 33 and 34 will align with a first reference mark 100 and second reference mark 101, which will be further described below and are shown in FIG. 7. In the preferred embodiment, the plaster cast blanket 30 is made of a quilted cloth-like material that is impregnated with plaster, or some similar material, which is powdery and flexible until it is wetter and allowed to dry. When wetted, the plaster cast blanket 30 cures into a final cast 36 within about 30 minutes. The plaster cast blanket is of the same type of material that is used to make casts for broken appendages.

Figure 4:
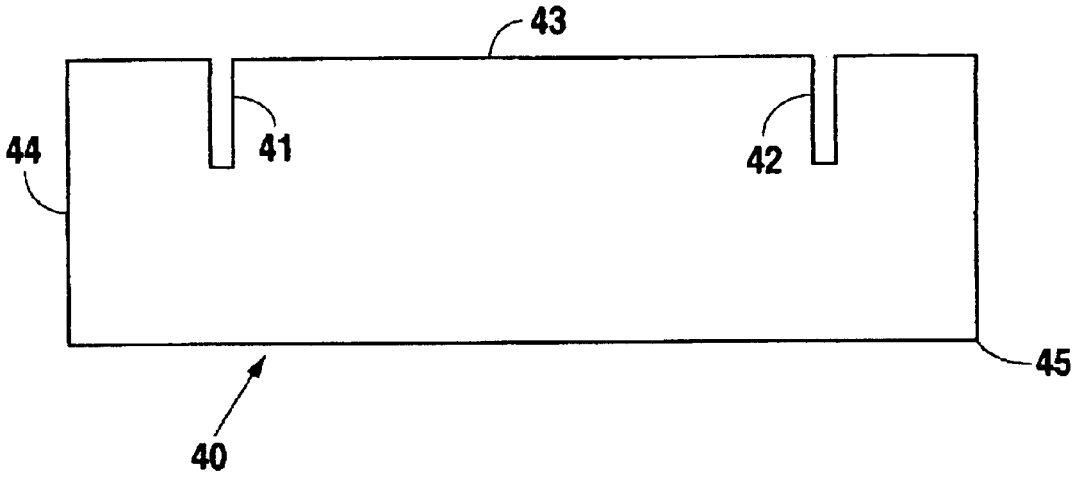
FIG. 4 is a side view of a measuring tool.

Referring to FIG. 4, the measuring and marking tool 40 is a rectangular shape made from an appropriate semi rigid material, such as cardboard or plastic. A first notch or cut out 41 and second notch or cut out 42 extend perpendicular from a top edge 43 approximately halfway through the measuring tool 40. The notches 41 and 42 are spaced along the top edge 43 so that the first reference mark 100 and second reference mark 101 can be properly marked in the horse's hair as fully described below regarding FIG. 7. Both notches 41 and 42 should be wide enough to allow the piece of chalk to 4 create the first reference mark 100 and second reference mark 101.

Figure 5:
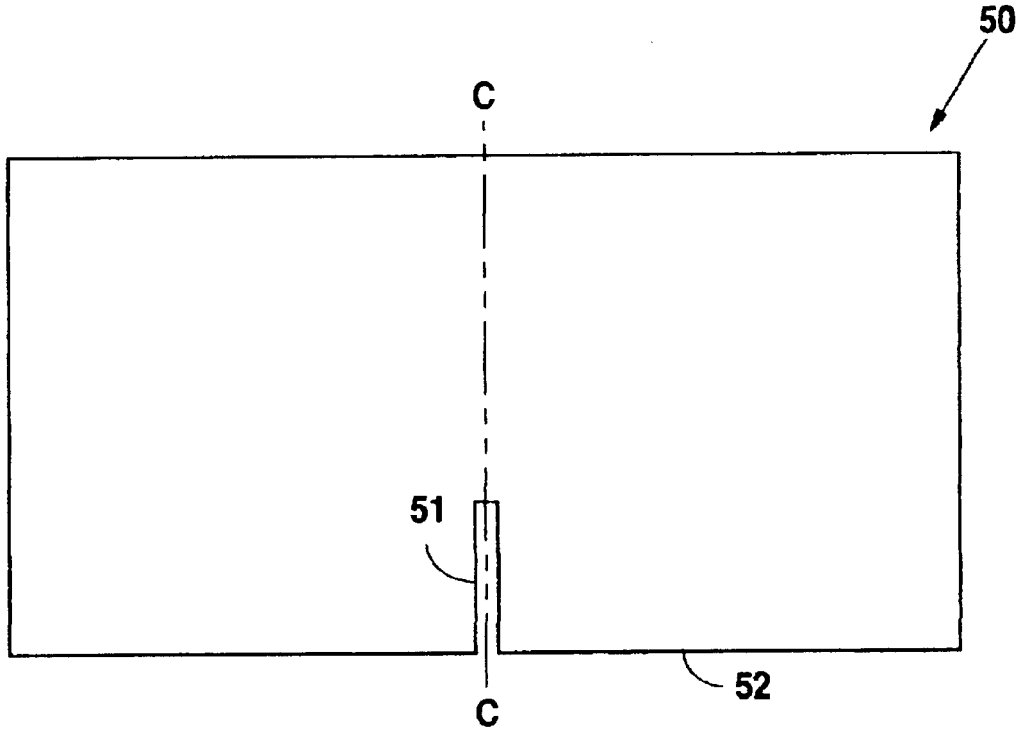
FIG. 5 is a front view of a cutout blank.

Referring to FIG. 5, a first cutout blank 50 is shown a generally rectangular shape made from an appropriate semi rigid material, such as cardboard or plastic. A cutout or notch 51 extends perpendicular from a bottom edge 52 along a centerline C—C for a specified distance equal to the length of the notches 41 and 42. The cutout or notch 51 should be wide enough to allow the first cutout blank 50 to mate with the measuring tool 40 to create a cradle 200 as fully described below regarding FIG. 12. The second cutout blank 60 is identical to the first cutout blank in material and shape, which includes a bottom edge 62 and a cutout or notch 61 to mate with the measuring tool 40.

The conventional flexible forming tool 70 is commonly used for transferring the outline or contour of a surface to another media. The forming tool has a bendable core that retains its bent shape when bent. It may have a protective plastic or rubber coating. Consequently, it is an appropriate tool for transferring the contours of a horse to a first and second cutout blank 50 and 60. At first glance, the flexible forming tool 70 appears to be similar to a ruler or a straight edge. However, the flexible forming tool 70 is flexible enough so that a slight amount of pressure will cause it to conform to the contours of any area in which it is in contact. Once the flexible forming tool 70 forms to the contours, gentle handling will allow the contour to be retained and then traced onto another location. After each use, the flexible forming tool 70 can be straightened out and used again.

Figure 6:
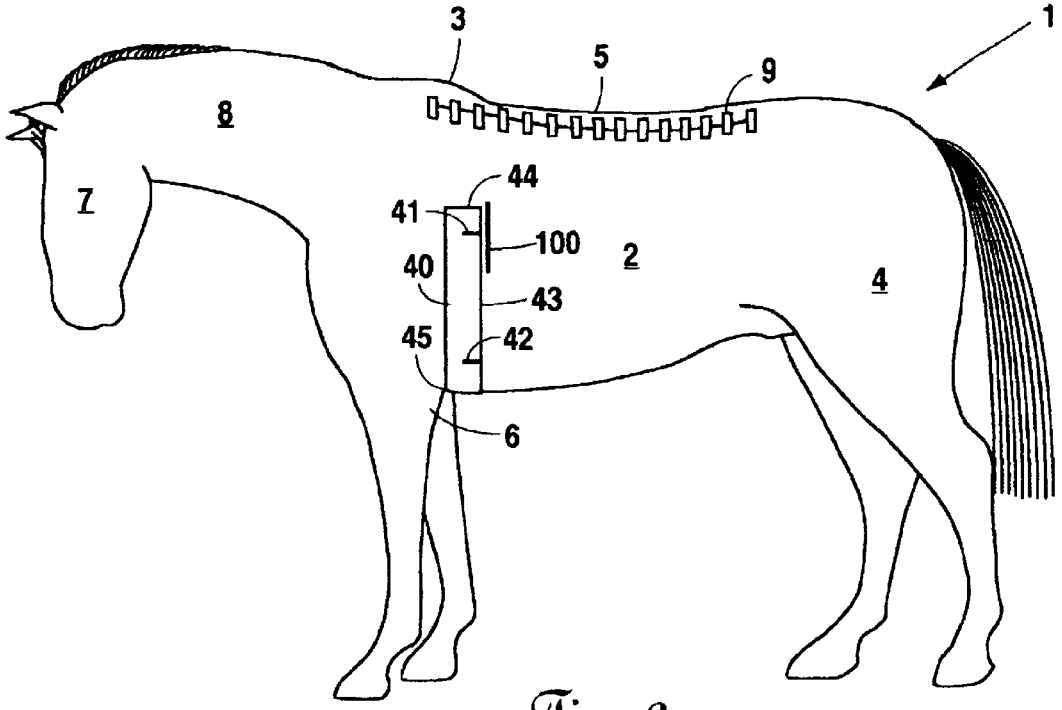
FIG. 6 is a side view of a first reference line on a horse.

Referring to FIG. 6, an initial step is to position the horse 1 in a working position. The working position is defined as when the horse 1 is standing with its head 7 down so that its neck 8 is as close to horizontal as possible. This causes the spine 9 of the horse to straighten as close to linear as possible resulting in an accurate fitting. To obtain an accurate fitting, it is important that the horse 1 remain in this working position during the entire fitting process.

The next step is to mark a first reference mark 100 and second reference mark 101 on the midsection 2 of the horse's hair. To accomplish this, the measuring tool 40 is positioned vertically against the midsection 2 with a top edge 43 perpendicular to the ground and a corner 45 positioned against a front elbow or joint 6 of the front leg. Then, the measuring tool 40 is used as a straightedge and measuring device to mark the first reference mark 100 along the top edge 43 from about the first cutout notch 41 to the left edge 44 onto the horse's midsection 2 with the piece of chalk.

Referring to FIG. 7, the measuring tool 40 is then positioned horizontally against the midsection 2 with the notches 41 and 42 facing up and the first notch 41 in parallel alignment with the first reference mark 100. Next, the measuring tool 40 is used as a stencil to mark the second reference mark 101 along the second notch 42 onto the midsection 2 with the piece of chalk. The second reference mark 101 should be parallel to the first reference mark 101 and approximately the same length.

Figure 8:
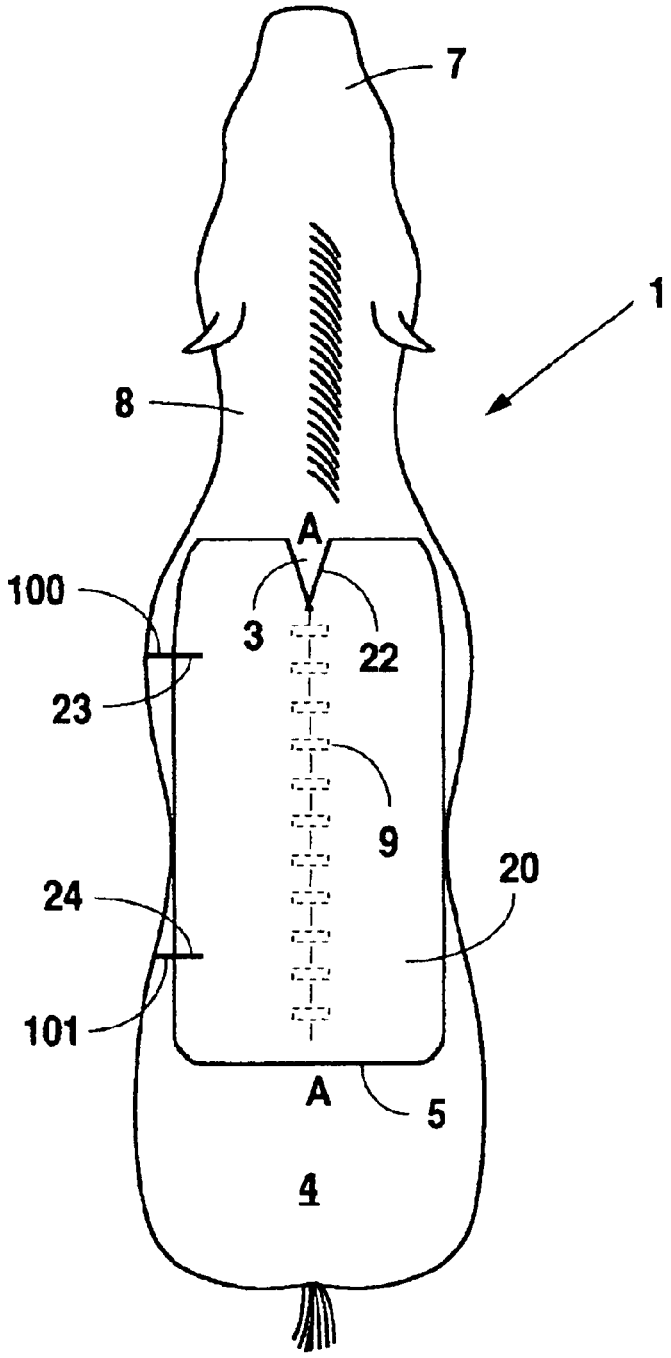
FIG. 8 is an overhead view of a horse pad positioned on the horse.

As will be apparent, the size of the measuring tool is such that it will work with most horses. However, the reference marks may have to be adjusted depending on the size and breed of the horse. It should be wide enough to position the reference mark 100 at a location just at or slightly behind the horse withers, as shown in FIG. 7, similarly the notches or cutouts 41 and 42 have to the positioned and spaced so they locate the reference marks 100 and 101 generally in the area shown in FIG. 7. This generally coincides with the depressed portion of the horse's back. The reference mark 101 acts as a check and let the fitter know that the pad and cast are properly positioned on the horse's back for fitting Referring to FIG. 8, the next step is to properly position the pad 20 on the horse's back 5 of the horse 1. To properly position the pad 20, the slit 22 faces the head 7 of the horse 1 with the centerline A—A in parallel alignment with the spine 9. Additionally, the first pad mark 23 and second pad mark 24 align in parallel with the first reference mark 100 and second reference mark 101, respectively. It is very important that the entire surface of the pad 20 conform to the horse's back 5. The protruding area around the withers 3 is especially problematic because the pad 20 may bridge across the area, rather than conform to it. Usually, the slit 22 prevents this problem by allowing the withers 3 to protrude through the slit 22, thus, allowing the pad 20 to conform to the horse's back 5. However, the many different sizes and shapes of horses of different sizes and breeds make it possible that even this solution may not completely alleviate the problem. To help overcome any further problems in this area, it may be necessary to wet the pad 20 with water around the area. Wetting the area makes the pad 20 softer and more flexible allowing the pad 20 to be pressed down into any depressions on the horses back 5.

Figure 9:
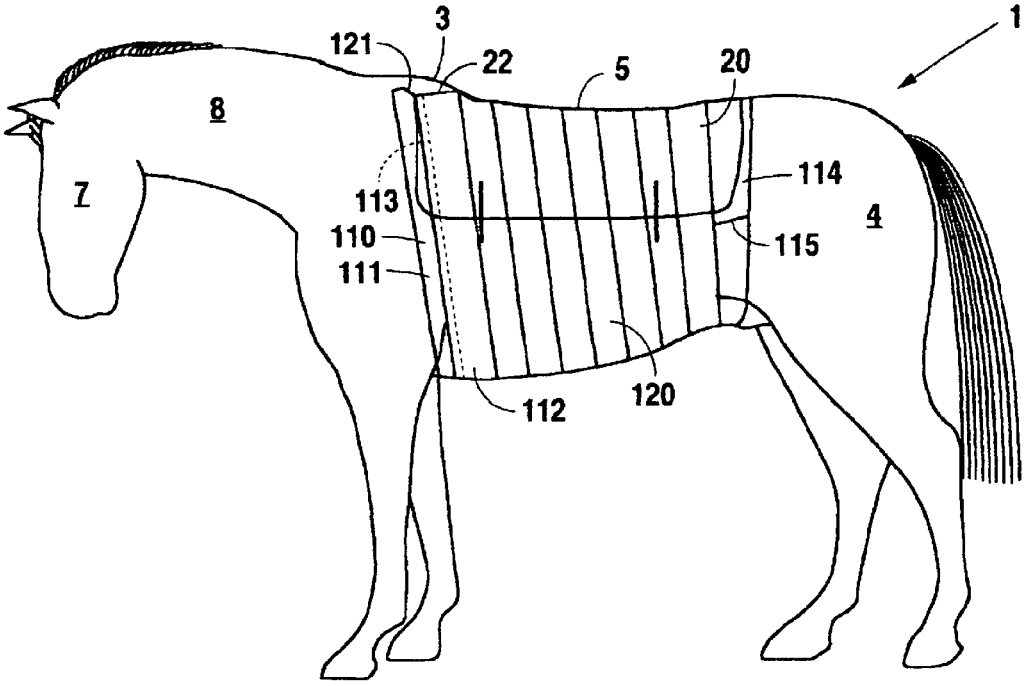
FIG. 9 is a side view of the horse pad secured onto the horse with a plastic wrap.

Referring to FIG. 9, the pad 20 is secured onto the horse's back 5 using the a wrapping material or strapping such as the suggested spool of stretchable plastic wrap 10 to form a retaining wrap 120 around substantially the entire circumference of the midsection 2 and pad 20. Although a single person can accomplish the step, it may be easier to perform this step with two people depending on the size and demeanor of the horse. Starting at the front edge 21 of the pad 20, the fitter makes a first pass 110 by unrolling the plastic wrap 10 around the entire circumference of the midsection 2 and over the pad 20 so that the plastic wrap 10 ends up back at the starting position. While unrolling the plastic wrap 10, it is important to maintain enough tension to slightly stretch the plastic wrap 10. This insures that the pad 20 is firmly secured to the horse's back 5 and will not slide around during the remaining steps. Next, make a second pass 111 by unrolling the plastic wrap 10 around the entire circumference of the midsection 2 completely overlapping the first pass 110. Care must be taken to make sure that the horse does not expand its girth substantially to affect the fitting. Other wrapping or strapping materials could be used.

Remembering to apply enough tension on the wrap 10, the fitter makes a third pass 112 by unrolling the wrap 10 around the entire circumference of the midsection 2. Instead of completely overlapping the first pass 110 and second pass 111, this time the fitter only overlaps an edge 113 of the second pass so that the third pass 112 partially overlaps the second pass 111 and partially covers a new section of the pad 20 and midsection 2. In this manner, the fitter continues to make more passes around the entire circumference of the midsection 2 and pad 20 with the wrapping or strapping material until the most pad 20 is completely secured by wrap 10. When done properly, a shallow spiral type pattern emerges, with each successive pass coming closer to the hindquarters 4 of the horse 1. When the entire pad 20 is covered, make a final pass 114 completely overlapping the previous pass. Finally, cut the plastic wrap 10 from the spool and smooth the cut end 115 against the plastic that is already unrolled completing a plastic wrap 120.

At this point, the fitter should inspect the position of the pad 20 to insure that is still properly positioned on the horse's back 5. If not, the fitter may have to remove the wrapping 120 and return to the step of positioning the pad 20. Also, the fitter should inspect the area around the withers 3 to identify any bridging of the plastic wrap 120 due to the protrusion of the withers 3. To alleviate any bridging, a fitter can use the scissors to cut a wrap slit 121 in the plastic wrap 120 parallel to the slit 22 just long enough to allow the plastic wrap 120 to conform to the pad 20. The fitter should not cut the wrap 120 to such an extent that its ability to securely hold and retain the pad 20 secure is compromised.

Figure 11A:
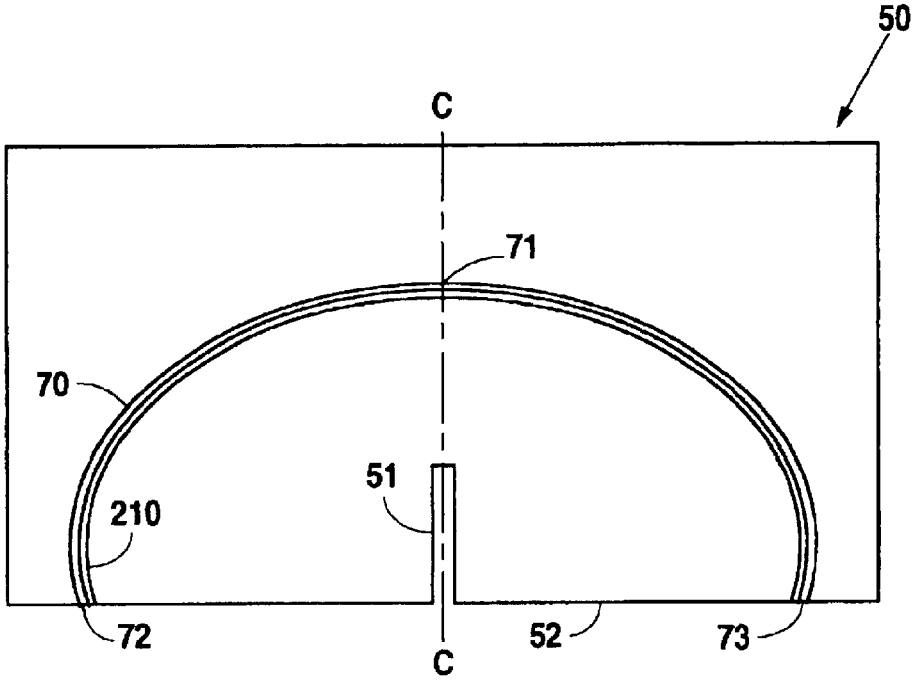
FIG. 11A is an overhead view of a flexible forming tool on a first blank.

Next, the user should create a cradle 200 on which the cast 36 can be safely transported and checked. Referring to FIG. 12, the cradle 200 includes a first template 201 and a second template 202 which have been cut to match the unique contour of the horse's back and assembled with the measuring tool 40 so that the cast 36 rests securely on the cradle 200. To do this the fitter should position the flexible forming tool 70 in parallel alignment with the first reference mark 100 so that a midpoint 71 aligns with the spine 9. The user then can carefully conform the flexible forming tool 70 flush to the horse's back 5 into the shape of a first contour 210. Then, the fitter should carefully remove the flexible forming tool 70, taking care not to let it bend or otherwise loose its shape conforming to the horse's back. Referring to FIG. 11A, the fitter then positions the flexible forming tool 70 on the first cutout blank 50, making sure to align the midpoint 71 of the flexible forming tool 70 with the centerline C—C and the two ends of the rule 72 and 73 even with a bottom edge 53 of the first cutout blank 50. Next, the fitter traces the first contour 210 onto the first cutout blank 50. Once the tracing is made, the fitter removes the flexible forming tool 70 and cuts the first cutout blank 50 along the first contour 210 to create the first template 201, shown in FIG. 12.

Figure 11B:
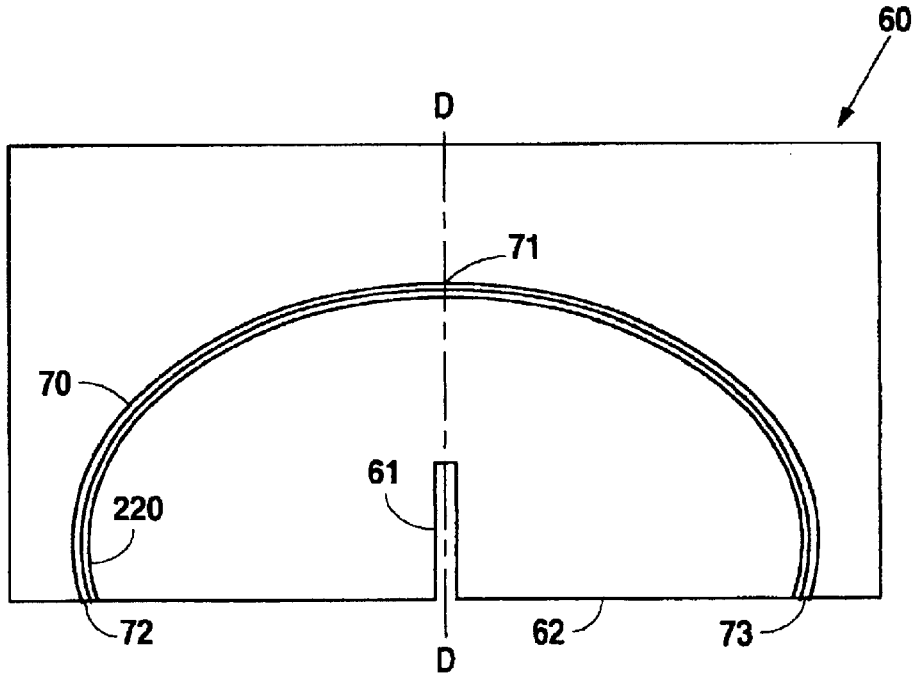
FIG. 11B is an overhead view of a flexible forming tool on a second blank.

Referring to FIG. 11B, the second template 202 is created in a similar manner to the first template 201. The fitter positions the flexible forming tool 70 in parallel alignment with the second reference mark 101 so that the midpoint 71 aligns with the spine 9. Gently conform the flexible forming tool 70 flush to the horse's back 5 into the shape of a second contour 220. Then, the fitter then carefully removes the flexible forming tool 70 taking care not to let it bend or otherwise loose its shape that conforms to the horse's back. Referring to FIG. 11B, the fitter positions the flexible forming tool 70 on the second cutout blank 60, making sure to align the midpoint 71 of the flexible forming tool 70 with the centerline D—D and the two ends of the rule 72 and 73 even with a bottom edge 63 of the second cutout blank 60. Next, the fitter traces the second contour 220 onto the second cutout blank 60. Once the tracing is made, the fitter removes the flexible forming tool 70 and cuts the second cutout blank 60 along the second contour 220 to create the second template 202, shown in FIG. 12.

To assemble the cradle 200, the fitter inserts the cutout notch 51 of the first template 201 into the first notch 41 of the measuring tool 40 so that the first template 201 is perpendicular to the measuring tool 40. Next, the fitter inserts the cutout or notch 61 of the second template 202 into the second notch 42 of the measuring tool 40 so that the second template 202 is perpendicular to the measuring tool 40. The assembled cradle 200 supports the final cast 36 without deforming the shape during transport. The cradle also will act as a reference to indicate that the casting was correctly done.

Figure 10:
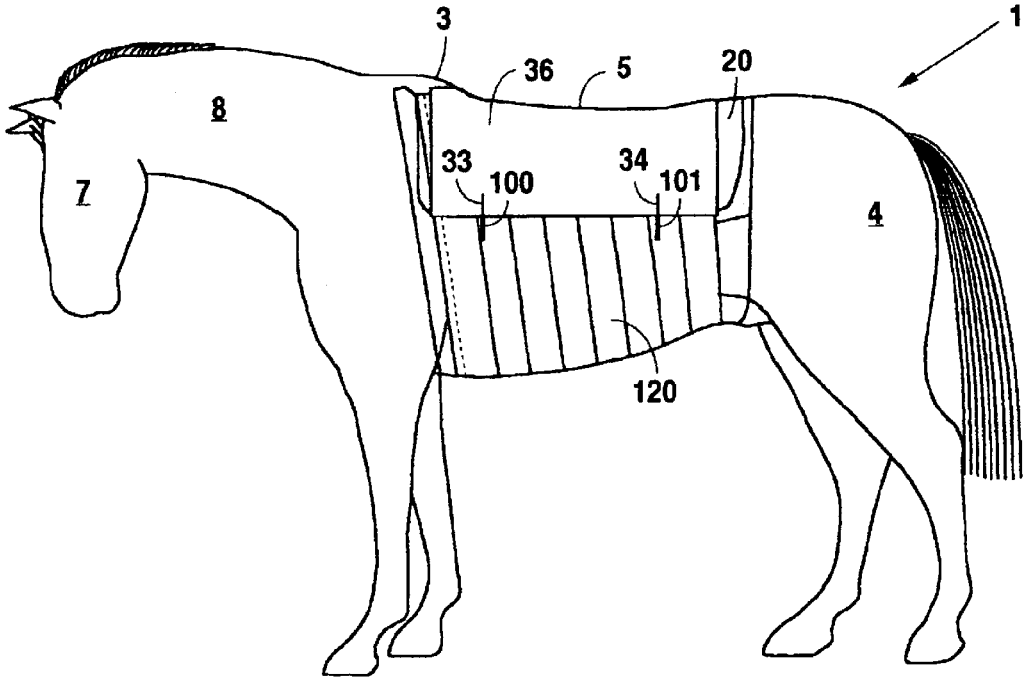
FIG. 10 is a side view of the plaster cast blanket positioned on the horse.

Referring to FIG. 10, the next step in the process is to form a cast 36 of the horse's back 5 that can be transported back to the shop or manufacturer. In order to do this the fitter activates the plaster cast blanket 30, by immersing it in a water bath long enough to wet and saturate the entire blanket 30. If necessary, the plaster cast blanket 30 may be folded in half multiple times to allow immersion in a smaller water bath, such as a plastic five-gallon bucket. A quick immersion in the water is all that is necessary because the plaster cast blanket 30 absorbs water quickly. A prolonged immersion will not yield better results. Instead, it may cause excessive amounts of plaster to be lost from the plaster cast blanket 30 resulting in a poor final cast 36. In the preferred embodiment, room temperature water is used because it cures the cast 36 faster than cool water. However, warmer water may be used in cold temperature weather to help offset the extended curing times that are associated with colder temperatures.

After the plaster cast blanket 30 is removed from the water, the fitter may gently squeeze the blanket to remove excess water. The squeezing of the plaster cast blanket 30 is not intended to dry the blanket 30, but merely to remove excess water 30. After the excess water is removed, position the blanket 30 onto the horse's back 5 so that the slit 32 faces the head 7 and the first blanket mark 33 and second blanket mark 34 are in parallel alignment with respective first reference mark 100 and second reference mark 101. In addition, the centerline B—B should be positioned in parallel alignment with the spine 9. The slit 32 allows the withers 3 to protrude through the blanket 30 allowing the blanket 30 to better conform to the horse's back 5. It is extremely important that the plaster cast blanket 30 precisely conforms to the contours of the horse's back 5 to achieve a satisfactory cast 36. It may become necessary to increase the length of the split 32 if the horse 1 has exaggerated withers 3 or the plaster cast blanket 30 does not fit properly for any reason. Lengthening the split 32 is accomplished by using the scissors to extend the split 32. However, the fitter should only extend the split 32 at the minimum distance required to achieve an accurate cast 36.

After the plaster cast blanket 30 is properly positioned, the fitter may gently slide the open palm of a hand over of the blanket 30 to conform the blanket 30 to the horse's back 5. This will also remove any remaining excess water. During the first few minutes of activation, the plaster cast blanket 30 can be easily manipulated. However, as the amount of time from activation increases, the plaster cast blanket 30 will become more rigid and harder and eventually become impossible to manipulate. Therefore, it is essential that a proper fitting be accomplished in a relatively short amount of time from activation of the plaster cast blanket 30. In the preferred embodiment, the initial curing time is about 30 minutes. However, the initial curing time may vary according to the ambient atmosphere conditions.

As previously discussed, it is important to keep the horse 1 from moving from the working position during the curing of the plaster cast blanket 30. Once the plaster cast blanket 30 cures into a cast 36, the cast is removed and placed securely on the cradle 200 for support. The cast 36 will continue to cure over the next twelve hours, Finally, the cast 36 is shipped back to the manufacturer. There the manufacturer uses the cast 36 to produce a saddle shell of fiberglass or comparable material which can be used to make a saddle pad or saddle using conventional methods. The resulting saddle pad or saddle will closely fit the horse's back and provide comfort to the horse so the horse can perform to its maximum potential. The means the horse will not be injured or hurt by an ill-fitting saddle. The casting blanket 30 can also be made of other materials that cure quickly to a rigid form. Any material that can be easily activated and will quickly cure to a rigid shape, without affecting the horse, would be satisfactory.

Those skilled in the art can now appreciate from the foregoing description that the broad teachings of the present invention can be implemented in a variety of forms. Therefore, while this invention has been described in connection with particular examples thereof the true scope of the invention should not be so limited since other modifications will become apparent to the skilled practitioner upon a study of the specification and following claims.

I claim:

1. A method for fitting a horse for a custom fitting saddle pad or saddle, comprising the steps of:

positioning the horse in a generally working position with the neck horizontal and spine linear;

positioning a measuring tool against the horse adjacent the back of a horse's front leg and making a first reference mark; and marking the first reference mark along a top edge of the measuring tool to a left edge of the measuring tool;

positioning the measuring tool horizontally against the midsection with a first notch in the measuring tool aligning with the first reference mark; and marking a second reference mark on the horse along a second notch in the measuring tool parallel with the first reference mark;

positioning a flexible conforming pad on the back of the horse with the pad conforming to the horse's back and a first pad mark in parallel alignment with the first and second reference marks to properly position the pad on the horse's back;

securing the pad on the back at the midsection of the horse to maintain the pad contoured to fit the horse's back;

forming a rigid cast of the horse's back that is aligned with the first and second reference marks and over the pad for use in making a custom fitted saddle pad or saddle for the horse;

activating the pad;

conforming the pad to the shape of the back;

the step of securing the pad on the horse includes wrapping a wrap around the horse's mid section to substantially cover the wrap so that the wrap and pad substantially conform to the horse's back;

the step of forming the cast comprises immersing a plaster cast blanket in water;

removing the plaster cast blanket from the water;

positioning the plaster cast blanket that is wrapped on the horse;

conforming the plaster cast blanket to the shape of cast blanket that is wrapped on the horse;

curing the plaster cast blanket into a cast;

the step of forming a cast comprises positioning the plaster cast blanket on the wrapped horse with a slit facing the head of the horse with a centerline in parallel alignment with the spine of the horse and a first blanket mark and a second blanket mark in parallel alignment with the respective first reference mark and second reference mark;

the step of increasing the length of the slit so that the plaster cast blanket conforms to the shape of the wrapped horse;

the step of creating a cradle to support the cast for transport by positioning a flexible forming tool across the back of the horse in parallel alignment with the first reference mark and the midpoint positioned on the spine of the horse so that the flexible forming tool forms a first contour;

making a first template to conform to the flexible forming tool;

positioning the flexible forming tool across the back of the horse in parallel alignment with the second reference mark and the midpoint positioned on the spine of the horse so that the flexible forming tool forms a second contour;

making a second template to conform to the flexible forming tool;

inserting a first template notch into a first notch of the measuring tool so that the first template is perpendicular to the measuring tool; and inserting a second template notch into a second notch of the measuring tool so that the second template is perpendicular to the measuring tool.

2. A method for fitting a horse for a custom fitting saddle pad or saddle, comprising the steps of;

positioning a the horse in a generally working position with the neck horizontal and spine linear;

positioning a measuring tool against horse adjacent the back of the horse's front leg and making a first reference mark; and marking the first reference mark along a top edge of the measuring tool to a left edge of the measuring tool;

positioning the measuring tool horizontally against the midsection with a first notch in the measuring tool aligning with the first reference mark; and marking a second reference mark on the horse along a second notch in the measuring tool parallel with the first reference mark;

positioning a flexible conforming pad on a back of the horse with the pad conforming to the horse's back and a first pad mark in parallel alignment with the first and second reference marks to properly position the pad on the horse's back;

positioning a plaster cast blanket on a wrapped horse with a slit facing the head of the horse with a centerline in parallel alignment with the spine of the horse and a first blanket mark and a second blanket mark in parallel alignment with the respective first reference mark and second reference mark securing the pad on the back at the midsection of the horse to maintain the pad contoured to fit the horse's back by wrapping the wrap around the horse's mid section to substantially cover the wrap so that the wrap and pad substantially conform to the horse's back activating the pad; and conforming the pad to the shape of the back;

forming a rigid cast of the horse's back that is aligned with the first and second reference marks and over the pad for use in making the custom fitted saddle pad or saddle for the horse;

creating a cradle to support the cast for transport;

positioning a flexible forming tool across the back of the horse in parallel alignment with the first reference mark and a midpoint positioned on the spine of the horse so that the flexible forming tool forms a first contour;

making a first template to conform to the flexible forming tool;

positioning the flexible forming tool across the back of the horse in parallel alignment with the second reference mark and the midpoint positioned an the spine of the horse so that the flexible forming tool forms a second contour;

making a second template to conform to the flexible forming tool;

inserting the first template notch into a first notch of the measuring tool so that the first template is perpendicular to the measuring tool;

inserting the second template notch into a second notch of the measuring tool so that the second template is perpendicular to the measuring tool.

3. A system for fitting a horse for a custom fitting saddle pad or saddle, comprising:

a measuring tool for making at first and second reference marks on the horse;

the measuring tool having first and second speed notches to make the first and second reference marks;

means for making the first and second reference marks with the measuring tool;

a flexible pad for positioning on a back of the horse with the pad conforming to the horse's back and first and second pad in alignment with the first and second reference marks on the horse;

means for securing the pad on the back at the midsection of the horse to maintain the pad contoured to fit the horse's back;

means for forming the rigid cast of the horse's back over the pad for use in making the custom fitted saddle pad or saddle for the horse;

the means for forming a ridged cast of the horse's back is activated by wetting so the cast can be conformed to the shape of the horse's back;

the means for securing the pad on the horse includes a wrap for securing around the horse's midsection to substantially cover the wrap so that the wrap and pad substantially conform to the horse's back;

the means for forming the ridged cast includes a plaster cast blanket material for immersing a plaster cast blanket in water to activate the blanket for curing to a rigid cast;

a cradle to support the cast for transport;

a flexible forming tool is to make the cradle;

a first template for conforming to the flexible forming tool;

a second template for conforming to the flexible forming tool so that the first and second templates form supports for the measuring tool to form the cradle.

4. A system for fitting a horse for a custom fitting saddle pad or saddle, comprising;

a measuring tool for marking at first and second reference marks on the horse;

the measuring tool having first and second spaced notches to make the first and second reference marks;

means for marking the first and second reference marks with the measuring tool;

a flexible pad for positioning on a back of the horse with the pad conforming to the horse's back and first and second pad marks in alignment with the first and second reference marks on the horse;

means for securing the pad on the back at the midsection of the horse to maintain the pad contoured to fit the horse's back;

the means for securing the pad on the horse includes a wrap for securing around the horse's mid section to substantially cover the wrap so that the wrap and pad substantially conform to the horse's back;

means for forming the rigid cast of the horse's back over the pad for use in making the custom fitted saddle pad or saddle for the horse the means for forming a rigid cast of the horse's back is activated to the cast can be conformed to the shape of the horse's back;

a cradle to support the cast for transport;

a flexible forming tool provided to make the cradle;

a first template for conforming to the flexible forming tool;

a second template for conforming to the flexible forming tool so that the first and second template form support for the measuring tool to form the cradle.

* * * * *